US005159891A

United States Patent [19]

Lohr et al.

[11] Patent Number: 5,159,891

[45] Date of Patent: Nov. 3, 1992

[54] ADJUSTABLE BOAT MOORING SYSTEM FOR A FLEXIBLY-SUPPORTED TENSION LEG PLATFORM

[75] Inventors: Curtis J. Lohr, Mandeville, La.; David A. Huete, Spring, Tex.

[73] Assignee: Shell Offshore Inc., Houston, Tex.

[21] Appl. No.: 748,402

[22] Filed: Aug. 22, 1991

[51] Int. Cl.[5] ..... B63B 22/02; B63B 21/50

[52] U.S. Cl. ..... 114/230; 114/293; 441/3

[58] Field of Search ..... 114/230, 293, 265; 441/3

[56] References Cited

U.S. PATENT DOCUMENTS 2,666,934 1/1954 Lefheit ..... 114/230 X
3,001,371 9/1961 Gilmore, Jr. et al. ..... 441/3
4,303,037 12/1981 Helveston et al. ..... 114/293 X
4,359,011 11/1982 Lyles ..... 114/230
4,446,807 5/1984 Johnson ..... 114/293 X

FOREIGN PATENT DOCUMENTS 2096963 10/1982 United Kingdom ..... 114/230

*Primary Examiner*—Sherman D. Basinger

[57] ABSTRACT

A backdown buoy-type mooring is provided which will pull supply vessels away from a tension leg platform while the supply vessel is being unloaded. The boat mooring system will consist of surface buoys attached to the top pad-eye of the lateral mooring intermediate buoys. The boat mooring system of the invention is configured for centering over a spaced array of ocean floor wells, being moved over to the farthest well, and adapted to be moved over to the nearest well.

9 Claims, 4 Drawing Sheets

10
13
16
21
21a
21b
22
22a
22b
22c
23
23a
32
33
34
35
36
37
38
39
40
41
41a
42
43
43a
44
48

10
17
49
43
43a
41a
42
41
40
23
22
22b
22c
22a
33
34
35
36
37
38
44
48
13
13

10
13
13
22
22a
22b
22c
23
23
33
33
34
35
36
37
38
40
40
41
41
41a
43
43
43a
44
44
48
49

ADJUSTABLE BOAT MOORING SYSTEM FOR A FLEXIBLY-SUPPORTED TENSION LEG PLATFORM

BACKGROUND OF THE INVENTION

Most oil and gas offshore production platforms presently in use are rigid structures having three or more rigid legs supporting one or more decks from which offshore oil wells are drilled and later produced. Supply boats are able to back down to these rigid structures and unload supplies or personnel by using any of various systems which have been developed. One such boat mooring system is described and illustrated in U.S. Pat. No. 4,359,011 which issued on Nov. 16, 1982 to Christopher J. Lyles.

Tension leg platforms, which are not rigid structures, have recently been designed and built for the development of oil fields in deep water, say, for example, in waters 2000 to 8000 feet deep. A tension leg platform is generally in the form of a large floating platform anchored at an offshore location by a vertical mooring system which may be enhanced by a lateral mooring system, if desired. The vertical mooring system is made up of a plurality of substantially vertical tendons which hang in tension between the buoyant platform on the surface of the ocean and the ocean floor where they are anchored to the ocean floor or to a rigid template. A lateral mooring system, if employed, may take the form of lateral catenary anchor lines extending from the platform outwardly and downwardly to anchors on the ocean floor. By using both anchoring systems, the floating platform is maintained in a substantially stationary position over wells to be subsequently drilled in the ocean floor.

A new method of using a tension leg platform to drill and maintain wells has been developed wherein the tendons and any production pipe lines extending between the platform and the ocean floor are sufficiently flexible in waters, say, 2500 feet deep, to allow the tendons and any vertical pipe lines to be flexed so that the floating platform may be moved laterally 400 feet or more to another fixed position. Thus, in drilling one well by this system, a centrally-located derrick on the drilling deck of the platform remains stationary over one drill site until the well is drilled, and/or completed, and/or shut in and abandoned. Subsequently, with the tendons of the tension leg platform anchored to the ocean floor, the floating platform supporting the flexible tendons is moved laterally from 50 feet to as much as 400 feet or more to a position directly over another well site where operations may be carried out.

SUMMARY OF THE INVENTION

It is an object of the present invention to provide an adjustable boat mooring system for use with a flexibly-supported tension leg platform without the need for re-setting any anchors used in the system.

A further object of the present invention is to provide a boat mooring system for use adjacent the top of a tension leg platform where supply barges are to be anchored for unloading, wherein the mooring system can automatically adjust to maintain a barge and the decks of the platform in the same relative spaced relationship when the top of the platform is moved laterally to a new position.

In accordance with the present invention, a boat mooring system is provided for use in conjunction with a flexibly-supported tension leg platform located in deep water (e.g., 2500 feet) that utilizes a vertical mooring system of tendons anchored to the ocean floor and a lateral mooring system extending a substantial distance (e.g., 10,000 feet) to anchors set in the ocean floor. Each anchor line is provided with one or more spaced buoys to increase the lateral force component on the platform. Outboard of the platform at a distance greater than the length of a supply barge, a barge anchor system is provided which is anchored at the lower end to one of the platform anchor lines, or to a buoy secured thereto. The other end of the barge anchor line is connected to a surface buoy or, alternatively, to another higher underwater buoy which is connected by a line to the surface buoy.

The surface buoy is unique in that it is slidably mounted on its anchor line for movement therealong. The end of the anchor line extending outside the sliding surface buoy is provided with a stop to prevent separation of the line from the buoy and is further provided with a connector, such as a pad-eye, for making connection to a bow hawser of a supply boat. One or more hawsers at the stern of the boat are connected to the platform to hold the boat at a selected distance from the platform when the boat's engine is running in a forward position. Tension on the bow hawser is provided by a hawser winch at the bow of the boat. Thus, tension is provided to keep the supply boat from backing into and damaging the platform in the event that the engine on the supply boat stops running.

These and other features of the invention will be more clearly understood from the following description taken with reference to the drawing.

DESCRIPTION OF THE PREFERRED EMBODIMENT

Figure 1:
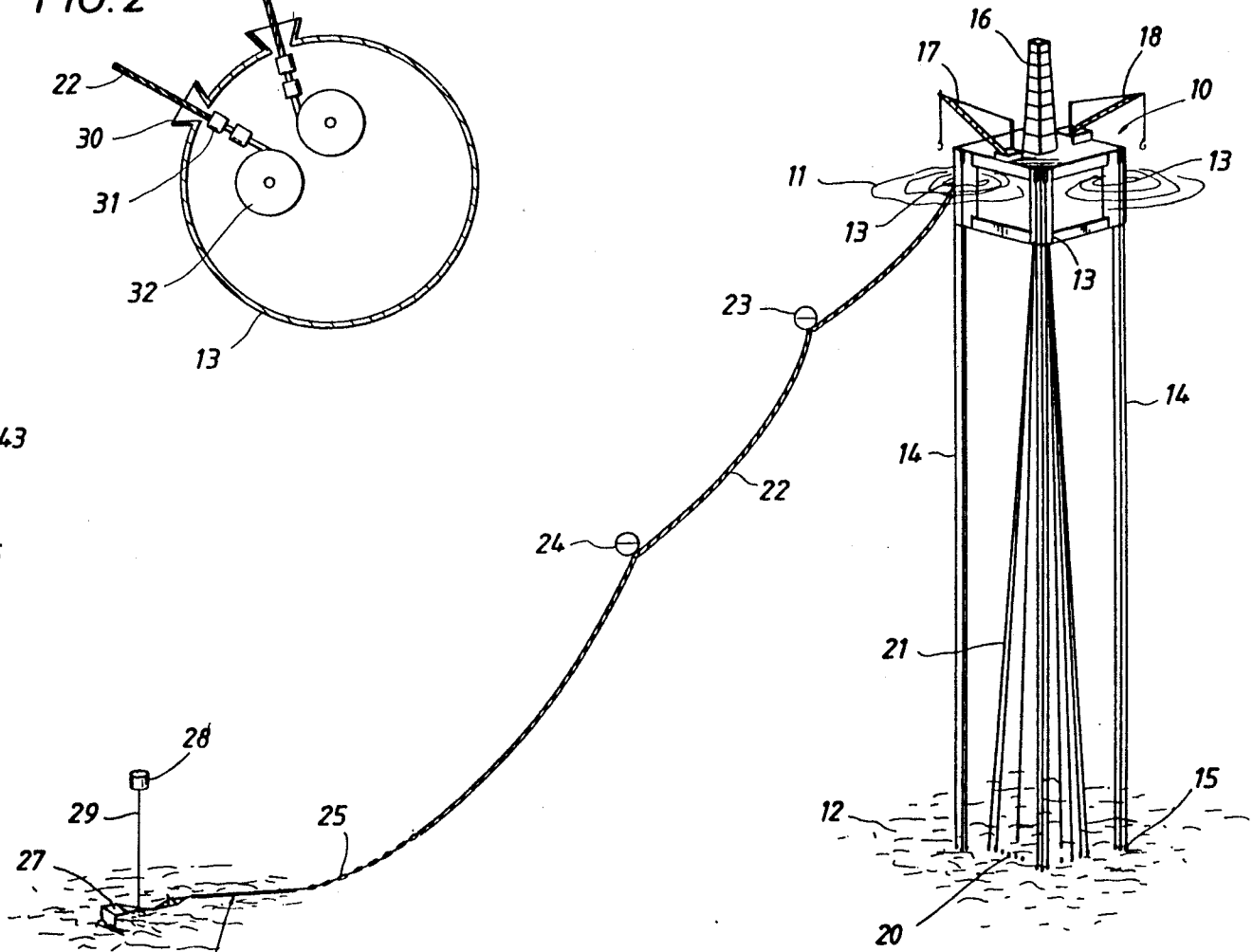
FIG. 1 is an isometric view of a tension leg platform positioned above the ocean surface and anchored to the ocean floor by means of a series of tendons with one anchor line diagrammatically illustrated as extending downwardly from the platform to the ocean floor.

Referring to FIG. 1 of the drawing, a tension leg platform 10 is illustrated as floating on a body of water 11 while being anchored to the ocean floor 12. The platform 10 is provided with four corner columns 13 which make the platform sufficiently buoyant to maintain a series of tendons in tension while they are anchored to the ocean floor in any suitable manner. The tendons 14 may be latched to templates 15 previously anchored on the ocean floor in a manner well known to the art. In this case being illustrated, the tendons are 2500 feet in length and consist of three tendons at each corner of the platform. In this case the tendons may be made of pipe which is 26 inches in diameter.

The platform 10 is provided with a centrally located derrick 16 which remains stationary on the platform and is used in drilling or working over any of the wells located below the platform 10.

A plurality of well drill sites 20 are shown as being arranged in a rough circle on the ocean floor. The circle may be 200- to 400-feet in diameter. As shown, several of the wells have already been drilled with a production pipe string 21 connecting the wellhead and extending upwardly to the deck of the platform 10. When a well is drilled, the entire platform 10 is moved to a location so that the derrick 16 will be directly above the well site 20 to be drilled. Since the tendons 14 which extend outwardly 2500 feet are flexible, the platform is moved on its lateral mooring system by winching up on some of the anchor lines and letting out on other of the anchor lines.

The platform is shown as being supplied with two cranes 17 and 18 for lifting supplies from a vessel and off-loading them onto the platform.

The lateral anchoring system of the platform 10 comprises a plurality of anchor lines (e.g., four) secured to the lower part of the platform at spaced-apart compass points which lines extend to the ocean floor anchors a distance from the bottom of the platform, preferably as great as the depth of the water. In FIG. 1, a single anchor line 22 is shown for illustration purposes as being provided with a pair of buoys 23 and 24 which for purposes of description will be called an intermediate buoy 23 and a riser buoy 24. It may be seen that the buoys 23 and 24 secured to the anchor line 22 form multiple catenaries in each anchor line to increase the lateral force component on the platform 10. These are necessary due to the great weight of the anchor line which is made up of 5-inch spiral strand wire, thousands of feet in length. Thus, the intermediate buoy 23 has a buoyancy rating of 90 kips, whereas the riser buoy 24 may have a buoyancy rating of 140 kips. The lower end of the anchor line 22 may be provided with, say, 1500 feet of dip chain which in turn is connected to a ground wire 26 of about 2500 feet or more. The ground wire is connected to an anchor of any suitable type 27, in this case, a fixed fluke anchor of 50 kips or more.

Figure 2:
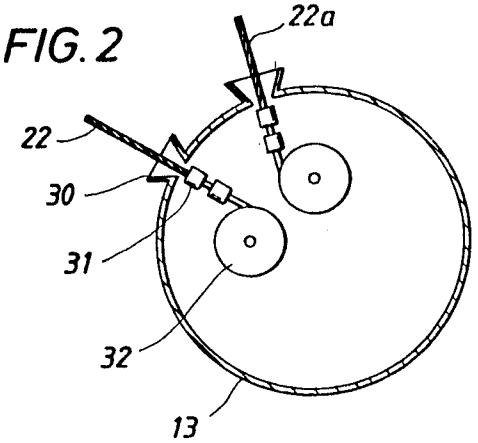
FIG. 2 is a diagrammatic view of a cross section of a column of the platform illustrating winch means for applying tension to the anchors.

To increase the stability of the platform 10, each column 13, as shown in FIG. 2, is provided with a pair of cables 22 and 22A shown as entering a port 30, being pulled therein by a linear winch system 31 which feeds the cable 22 onto a storage drum 32.

Figures 4, 5:
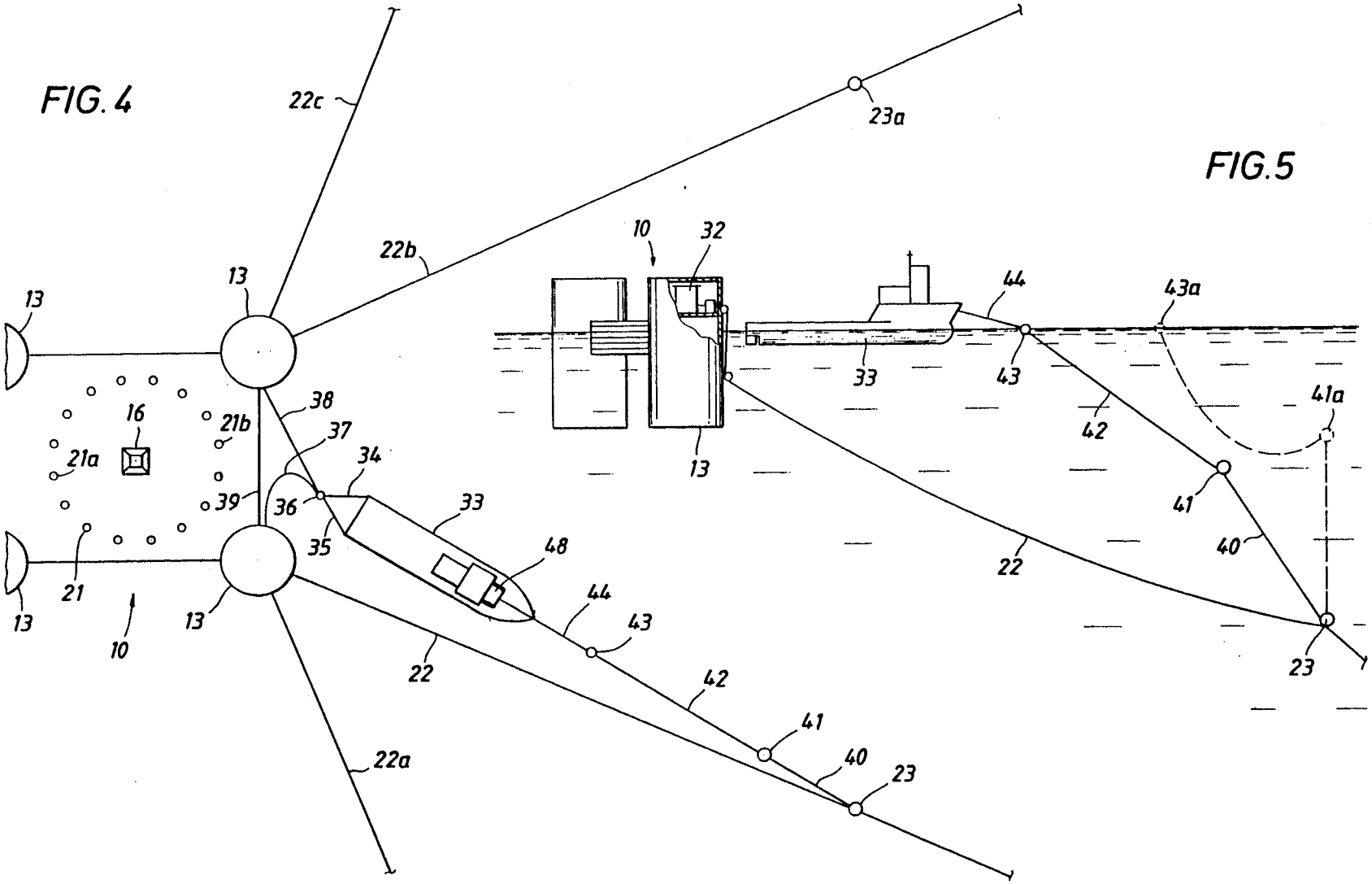
FIGS. 4 and 5 are plan and elevation views of a supply vessel anchored in close proximity to the tension leg platform in accordance with the present invention.

Referring to FIG. 4 of the drawing, the tension leg platform 10 is shown in plan view together with its derrick 16 which is centrally positioned over the drill sites 21, **21*a* and 21*b*. Positioned to the right of the platform is a supply boat 33 having mooring lines 34 and 35 at the stern thereof which are connected to a ring 36 which, in turn, is connected to mooring lines 37 and 38 that are secured to two columns of the platform 10. Any other suitable type of mooring arrangement may be used as long as two lines are secured to the stern of the supply vessel 33. With the engine of the supply vessel 33 running in forward position, sufficient tension is provided on line 38 to keep the vessel away from the platform 10. In the event of failure of the engine, the vessel 33 might back into the platform 10. A wire net barrier 39** may extend between the two columns to prevent the supply vessel form backing into any of the pipes coming from the wells.

Figure 3:
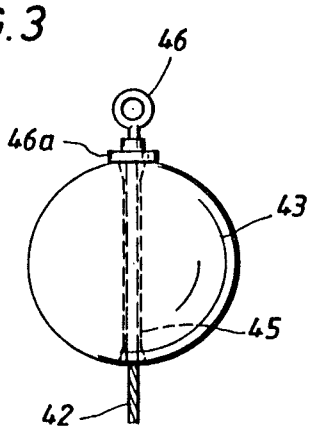
FIG. 3 is a diagrammatic view of one form of a slidable buoy to be used with the present invention.

As a precautionary measure, the platform is provided with an adjustable boat mooring system in accordance with the present invention. This mooring system comprises, say, 180 feet of wire line 40 attached at one end to the anchor line 22, via or adjacent to the intermediate buoy 23 and at the other end to a submerged buoy 41. The submerged buoy 41 is connected by 250 feet of synthetic line 42 to a sliding buoy 43 at the surface 11 of the water. As shown in FIG. 3 of the drawing, the sliding buoy may take the form of a buoyant sphere having a central opening therethrough in which the synthetic line 42 may slide. The end of the synthetic line 42 is attached to a ring 46 and stop means **46*a* of suitable size which is connected to a ring or other connector means by which the bow hawser 44 of the supply vessel 33** may be connected.

When the sliding buoy 43 is not connected to the bow hawser 44, the submerged buoy 41 moves to a vertical position **41*a* while the sliding surface buoy 43*a*** remains at the surface.

Figures 6, 7:
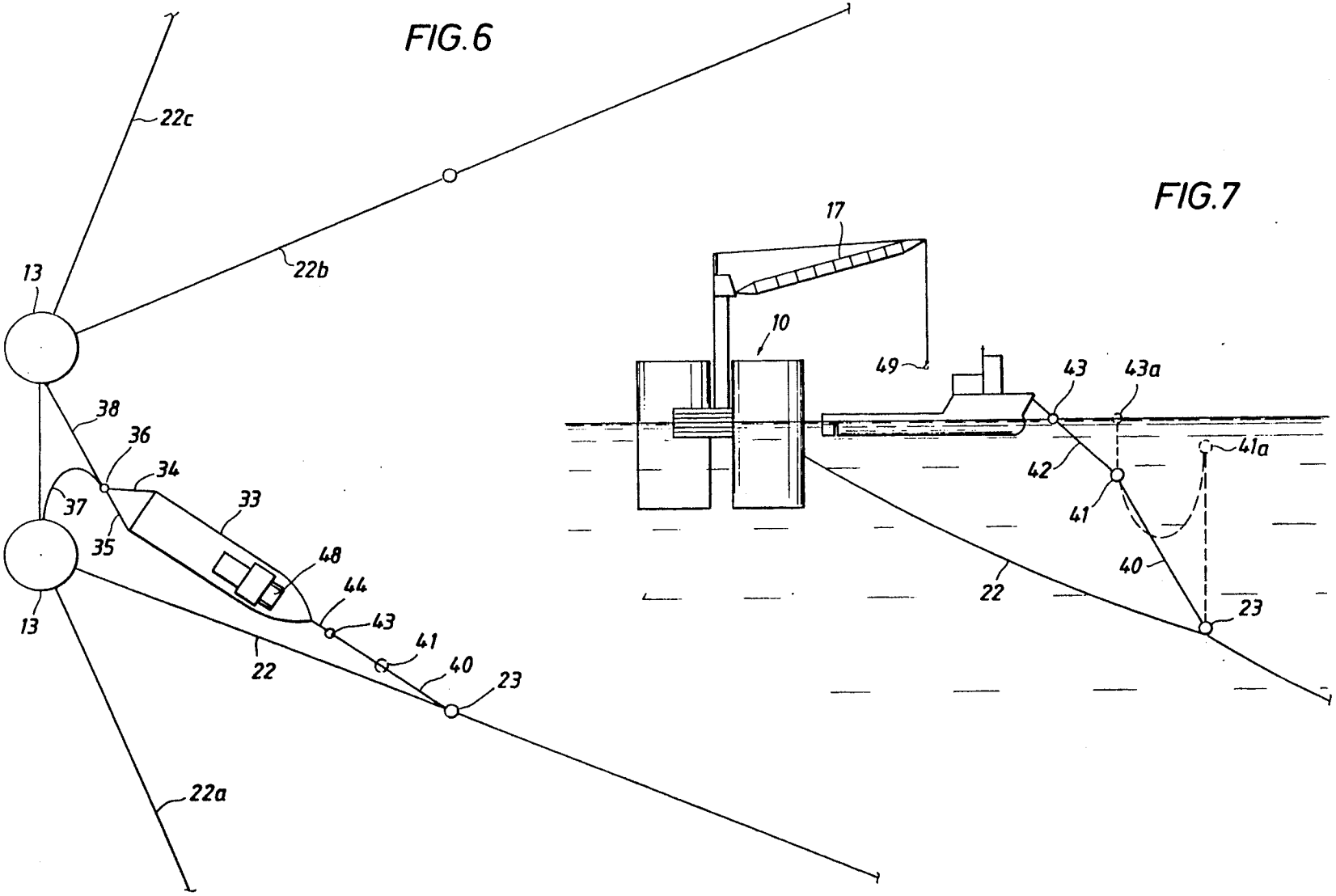
FIGS. 6 and 7 are plan and elevation views of the platform and supply vessel of FIGS. 4 and 5 with the platform and supply vessel being in an offset position in one direction compared to the normally central position shown in FIGS. 4 and 5.

If it is desired to drill a well through drill site **21*b* (FIG. 4), the entire platform 10 would be moved laterally, say, 200 feet to the right, so that the derrick 16 in the center of the platform would be directly over the well site 21*b*. This would be accomplished by reeling in the lateral mooring lines 22, 22*a*, 22*b* and 22*c* of the platform 10 by use of the linear winch system (FIG. 2) in a manner well known to the art. At the same time, the anchor lines of the opposite side of the platform 10 would be let out so that the platform at the ocean's surface would be moved, say, 200 feet to the right while the tendons 14 forming the vertical anchoring system of the platform 10 would flex to the right along with any other vertical pipes while the tendons remain anchored to the ocean floor, as at 15. When this movement has been accomplished, the supply vessel 33 would be moved closer to the intermediate buoy 23 on the lateral anchor line 22. At the same time, the intermediate buoy 23 would move up in the water from a depth of, say, 320 feet to a depth of 240 feet due to more line being taken in at the platform. At the same time, the synthetic line 42 would be shortened and would pass through the sliding buoy and would be reeled aboard the supply vessel 33 by means of its winch 48. The additional line taken up when anchor line 22 is shortened would be stored on the platform on a storage drum 32. When the supply vessel 33 has discharged its cargo and released itself from the sliding buoy 43, the submerged buoy 41*a* (FIG. 7) would assume a vertical position with the sliding buoy 43*a* remaining at the water surface. The unloading crane 17 of FIG. 1 is shown schematically in FIG. 7 together with its hook 49** used to unload cargo.

Figures 8, 9:
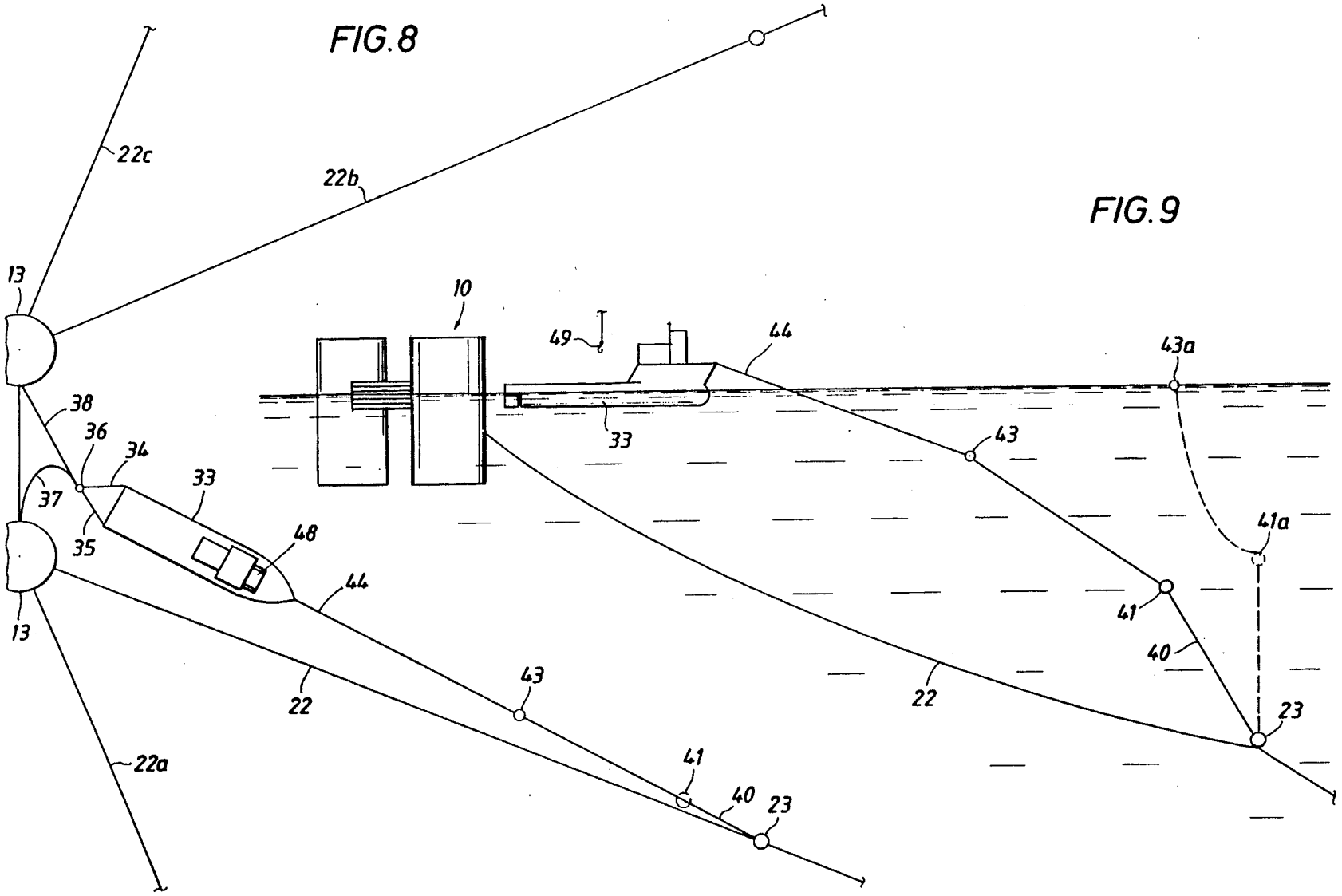
FIGS. 8 and 9 are plan and elevation views of the same platform and supply vessel when the platform has been moved in the farthest position away from that shown in FIGS. 6 and 7.

Again referring to FIG. 4 of the drawing, when it is desired to drill wellsite **21*a*, the platform 10 has to be moved to the left, as viewed in FIG. 4, until the derrick 16 is directly over the drill site 21*a*, say, 200 feet away. To get to this position, the lateral anchoring lines 22, 22*a*, 22*b*, and 22*c* would have to be let out from their storage chambers on the platform while the anchoring lines on the opposite side of the platform (not shown) would be taken up by the linear winch system as previously described with regard to FIG. 2. As shown in FIGS. 8 and 9, the supply vessel remains the same distance from the platform 10 but because of the added line put into the lateral anchor line 22, the intermediate buoy 23 is now a substantial distance away from the platform 10 and has sunk to a depth of about 400 feet. The surface buoy 43 has been pulled under water (FIG. 9) and additional line has been added to the bow hawser 44. The intermediate buoy 23 is now 820 feet from the platform 10 whereas in the situation described with regard to FIGS. 6 and 7, the intermediate buoy 23 was only 430 feet away from the platform 10. Upon disconnecting the supply vessel 33 from the adjustable boat mooring system of the present invention, the sliding buoy 43 (FIG. 9) will rise to the surface in a position shown at 43***a*.

What is claimed is:

1. A tension leg platform and a boat mooring system, comprising:

a floating platform having secured thereto a plurality of substantially vertical flexible tendons the lower ends of which are anchored to the ocean floor at spaced-apart points outside a defined well drilling area, said tendons extending to the ocean surface to be held in tension by the buoyant platform in a manner such that the center of the platform is moored substantially over the center of the well drilling area;

a plurality of lateral platform-mooring anchor lines secured to the lower part of the platform at at least a plurality of spaced-apart compass points thereof and extending to ocean floor anchors a distance from the platform;

buoy means secured to said anchor lines outboard of said platform to form multiple catenaries in each anchor line to increase the lateral force component on the platform;

at least one of said buoy means being an intermediate buoy positioned on an anchor line outboard of the platform for a distance greater than the length of a boat to be anchored;

a slidable buoy adapted to be mounted on a buoy line for sliding movement between the ends thereof;

a buoy line operatively secured in sliding relationship with said slidable buoy and operatively connected at the other end to a platform anchor line at a point adjacent said intermediate buoy, said buoy line being of a length sufficient to extend to the ocean surface; and connector means on the other end of said buoy line and outside said sliding buoy for connecting thereto the end of a bow hawser from a boat.

2. A tension leg platform and a boat mooring system, comprising:

a floating platform having secured thereto a plurality of substantially vertical flexible tendons, the lower ends of which are anchored to the ocean floor at spaced-apart points outside a defined well drilling area, said tendons extending to the ocean surface to be held in tension by the buoyant platform in a manner such that the center of the platform is moored substantially over the center of the well drilling area;

at least four lateral platform-mooring anchor lines secured to the lower part of the platform at at least four spaced-apart compass points thereof and extending to ocean floor anchors a distance from the platform at least as great as the depth of the water;

buoy means secured to said anchor lines outboard of said platform to form multiple catenaries in each anchor line to increase the lateral force component on the platform;

at least one of said buoy means being an intermediate buoy positioned on an anchor line outboard of the platform for a distance greater than the length of a boat to be anchored;

a submerged buoy;

a buoy line secured at one end to the submerged buoy and operatively connected at the other end to a platform anchor line at a point adjacent said intermediate buoy;

a second buoy line secured at one end to the submerged buoy and being of a length sufficient to extend from said submerged buoy to the ocean surface;

a slidable second buoy supporting the other end of the second buoy line at the ocean surface, said second buoy being slidably mounted on said second buoy line for movement between the ends thereof; and connector means on the other end of said second buoy line and outside said sliding buoy for connecting thereto the end of a bow hawser from a boat.

3. The tension leg platform and boat mooring system of claim 2 wherein the platform tendons are of flexible construction permitting the platform on the ocean surface to be moved laterally 50 feet or more from its normal position.

4. The tension leg platform and boat mooring system of claim 3 including means on the ocean floor marking a plurality of well locations within the perimeter of the defined well drilling area and spaced from the center thereof.

5. The apparatus of claim 4 including means carried by the platform for altering the lengths of the lateral platform-mooring anchor lines to move the platform laterally on the ocean surface to another offset position and directly over another well location without repositioning the anchors.

6. The apparatus of claim 5 wherein the means for altering the lengths of the anchor lines are winch means carried by said platform.

7. The apparatus of claim 5 including a boat having bow and stern end portions; and first hawser means connecting a first end portion of the boat to the platform on the ocean surface; and second hawser means connecting a second end portion of the boat to the connector means carried at the end of said second buoy line and supported by the slidable buoy.

8. The apparatus of claim 7 including winch means carried by said boat near the second end portion thereof and operatively connected to said second hawser means for varying the length of said hawser between the winch means and the connector means carried at the end of said second buoy line.

9. The apparatus of claim 1 including a plurality of winch means carried by said platform, each of said winch means being connected to one of said platform anchor lines for selectively lengthening and shortening said anchor lines.

* * * * *